US010974087B1

(12) United States Patent
Moon et al.

(10) Patent No.: US 10,974,087 B1
(45) Date of Patent: Apr. 13, 2021

(54) STRENGTHENING APPARATUS AND METHOD OF USE

(71) Applicants: Mitch Moon, San Luis Obispo, CA (US); Henry Moon, San Luis Obispo, CA (US)

(72) Inventors: Mitch Moon, San Luis Obispo, CA (US); Henry Moon, San Luis Obispo, CA (US)

( * ) Notice: Subject to any disclaimer, the term of this patent is extended or adjusted under 35 U.S.C. 154(b) by 0 days.

(21) Appl. No.: 17/076,761

(22) Filed: Oct. 21, 2020

Related U.S. Application Data

(60) Provisional application No. 63/003,465, filed on Apr. 1, 2020.

(51) Int. Cl.
*A63B 21/00* (2006.01)
*A63B 21/055* (2006.01)

(52) U.S. Cl.
CPC .... *A63B 21/00043* (2013.01); *A63B 21/0555* (2013.01); *A63B 21/0557* (2013.01); *A63B 21/4035* (2015.10)

(58) Field of Classification Search
CPC ..... A63B 21/0004; A63B 21/00043; A63B 21/00058; A63B 21/00069; A63B 21/00072; A63B 21/00076; A63B 21/00178; A63B 21/00181; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/072; A63B 21/0724; A63B 21/15; A63B 21/151; A63B 21/4027; A63B 21/4033; A63B 21/4035; A63B 21/4043; A63B 21/4045; A63B 71/0054; A63B 2071/0063; A63B 2071/0072;
(Continued)

(56) References Cited

U.S. PATENT DOCUMENTS 1,023,756 A * 4/1912 Pons ..... A63B 21/00043 482/128
3,746,339 A * 7/1973 Cox ..... A63B 21/0552 482/126
(Continued)

FOREIGN PATENT DOCUMENTS

JP 2001029505 A1 7/1999
JP 2007195904 A1 8/2007
(Continued)

OTHER PUBLICATIONS

International Design Reg. No. DM/ 210 453, International Designs Bulletin, Issue No. 40/2020, Published Feb. 10, 2020.

*Primary Examiner* — Gary D Urbiel Goldner
(74) *Attorney, Agent, or Firm* — TMB Law; Timothy M. Brown

(57) ABSTRACT

The invention provides an apparatus and method for strengthening the wrists, forearms and hands. The apparatus comprises a pair of elongate members that are slidable with respect to one another, with force being required for moving the elongate members away from one another. The apparatus enables a user to strengthen the wrist while maintaining it in a locked position. The apparatus finds particular use in rehabilitation and physical therapy for injuries of the wrist and hand.

21 Claims, 5 Drawing Sheets

(58) Field of Classification Search
CPC ..... A63B 2071/0081; A63B 2071/009; A63B 2210/00; A63B 2210/50; A63B 2210/52; A63B 2220/20; A63B 2225/09; A63B 2225/093
See application file for complete search history.

(56) References Cited

U.S. PATENT DOCUMENTS 3,938,803 A 2/1976 Wilmoth
D247,789 S 4/1978 Belkir
4,148,479 A * 4/1979 Spector ..... A63B 21/00043 482/112
4,155,547 A * 5/1979 Savio ..... A63B 23/14 482/127
4,193,593 A 3/1980 Wilson
4,211,405 A * 7/1980 Blowsky ..... A63B 21/00043 482/128
D262,129 S 12/1981 Kolbel
D263,327 S 3/1982 Cooper
D270,263 S 8/1983 Kolbel
D274,925 S 7/1984 Holcomb
4,489,937 A * 12/1984 Kong ..... A63B 21/00043 482/126
D278,548 S 4/1985 Backstrom
D281,446 S 11/1985 Keilman
4,580,778 A 4/1986 Van Noord
D285,329 S 8/1986 Boettger
D304,057 S 10/1989 Cooper
D313,827 S 1/1991 Smith
5,263,908 A 11/1993 Chen
D352,079 S 11/1994 Kang
D357,952 S 5/1995 Chen
D358,856 S 5/1995 Boettger
5,480,367 A * 1/1996 Bergman ..... A63B 21/0552 482/122
5,484,368 A 1/1996 Chang
5,569,125 A * 10/1996 Clementi ..... A63B 21/045 482/126
5,643,158 A * 7/1997 Clementi ..... A63B 21/00043 482/121
5,700,232 A * 12/1997 Clausen ..... A63B 21/0552 482/125
5,788,608 A * 8/1998 Wilkinson ..... A63B 21/0724 482/51
6,062,382 A * 5/2000 Czerkie ..... A01K 97/08 206/315.11
D428,946 S 8/2000 Boorstein
6,106,438 A 8/2000 Dean
D451,564 S 12/2001 Dean
D456,864 S 5/2002 Dantolan
6,402,667 B1 * 6/2002 Dahn ..... A63B 21/0087 482/121
D460,795 S 7/2002 Fitzpatrick
D470,201 S 2/2003 Paull
6,702,725 B2 3/2004 Hoffman
D500,101 S 12/2004 Fitzgerald
7,361,126 B2 4/2008 Bruce
D610,637 S 2/2010 Ford
7,704,198 B2 4/2010 Brown, Jr.
D633,155 S 2/2011 Brun
D639,357 S 6/2011 Brun
8,152,697 B2 * 4/2012 Wakuda ..... A63B 21/0004 482/49
D666,257 S 8/2012 Seraydarian
D669,545 S 10/2012 Miller
D694,348 S 11/2013 Rankin
8,602,952 B1 * 12/2013 Cruz ..... A63B 23/03575 482/126
8,951,169 B1 2/2015 Casper
9,925,404 B1 * 3/2018 West ..... A63B 21/0442
10,076,678 B2 * 9/2018 Sanseverino .... A63B 21/00043
10,307,632 B1 * 6/2019 Santana ..... A63B 21/4043
D853,505 S 7/2019 Toueg
D856,447 S 8/2019 Dunahay
10,806,960 B2 * 10/2020 Sanseverino .... A63B 23/03533
2001/0051561 A1 12/2001 Boorstein
2002/0160890 A1 * 10/2002 Fazio ..... A63B 23/03525 482/112
2006/0270534 A1 * 11/2006 Adcock ..... A63B 21/00185 482/128
2008/0167167 A1 7/2008 Munoz
2011/0092346 A1 4/2011 Wakuda
2013/0259561 A1 * 10/2013 Lai ..... A63B 29/021 403/33
2015/0126342 A1 * 5/2015 Kaye ..... A63B 21/00065 482/121
2015/0126345 A1 * 5/2015 Kaye ..... A63B 21/00065 482/129
2015/0126346 A1 * 5/2015 Kaye ..... A63B 21/00069 482/129
2015/0126347 A1 * 5/2015 Kaye ..... A63B 21/00069 482/129
2015/0133276 A1 * 5/2015 Kaye ..... A63B 23/03541 482/129
2015/0375032 A1 * 12/2015 Tong ..... A63B 21/055 482/121
2020/0222755 A1 7/2020 Adwan

FOREIGN PATENT DOCUMENTS

WO 2010068914 A1 6/2010
WO 2014043678 A1 3/2014
WO 2017091896 A1 6/2017
WO 2018137790 A1 8/2018

* cited by examiner

STRENGTHENING APPARATUS AND METHOD OF USE

CROSS-REFERENCE TO RELATED APPLICATIONS

This application claims the benefit of Provisional Application No. 63/003,465 filed Apr. 1, 2020, the entire contents of which are incorporated herein by reference for all purposes.

BACKGROUND OF THE INVENTION

The present invention relates to an apparatus for strengthening the wrists, forearms and/or hands. The apparatus finds particular use in physical therapy and rehabilitation exercise.

The wrists and hands are far more injury prone than other parts of the body since they are subjected to extreme trauma when breaking a fall, punching, or striking objects with handheld implements. Furthermore, certain physical professions can cause debilitating hand and wrist injuries, such as carpal tunnel syndrome.

Physical therapy for such injuries typically focuses on strengthening the hand, wrist and forearm. However, conventional strengthening tools, such as dumbbells or weight machines, generally focus on the upper arms, chest, shoulders or biceps. Very few exercise devices have been created that target the wrists, hands and forearms. Moreover, there does not presently exist an exercise device that rehabilitates the ability of a user to straighten their arm while the wrist is held locked. Thus, there exists a need for an exercise device that focuses on the rehabilitation and strengthening of the hand, wrist, and forearm and that strengthens the ability of a user to hold their wrist in a locked position while the arm is straightened.

SUMMARY OF THE INVENTION

The present invention provides an apparatus and method that focuses on strengthening the wrists, forearms and/or hands. The apparatus and method also provide a means for strengthening the ability of a user to hold their wrist in a locked position while the user's arm engages in a straightening motion.

DETAILED DESCRIPTION

The invention generally relates to a body strengthening apparatus. More particularly, the invention relates to a body strengthening apparatus for exercise and physical and rehabilitative therapy of the wrists, forearms and/or hands.

Figure 1:
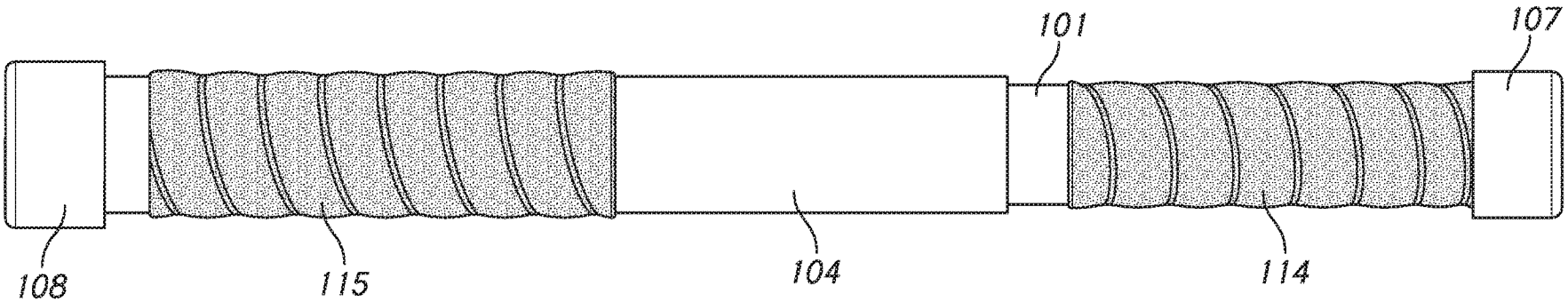
FIG. 1 depicts a plan view of an embodiment of the inventive apparatus.

FIG. 1 depicts a plan view of an embodiment of the inventive apparatus comprising elongate member 101 disposed within elongate member 104. The elongate members are slidable with respect to one another such that elongate member 101 is movable into and away from elongate member 104. A resistance element coupled to the elongate members provides resistance to the movement of elongate member 101 away from elongate member 104. The distance of the movement of elongate member 101 away from elongate member 104 can be limited to a maximum distance by a limiting element coupled to the elongate members. In some aspects of the operation of the apparatus, a user gripping elongate member 101 in one hand and elongate member 104 in the other hand can withdraw elongate member 101 from elongate member 104 for a distance and against the resistance of the resistance element. The apparatus can have a textured surface on at least a portion of the apparatus for enhancing a user's grip on the apparatus. For example, the apparatus can have at least one of textured surface 114 and textured surface 115. The textured surfaces can comprise any material or feature capable of enhancing a user's grip on the apparatus. The textured surfaces can be projections (e.g. knurling), grip tape, rubber, foam, foam tape, textured paint, a rubber spray coating, a textured rubber spray coating, or combinations thereof. In some embodiments, the apparatus comprises at least one of cap 107 on an end of elongate member 101 and cap 108 on an end of elongate member 104.

Elongate members 101 and 104 can have any geometric configuration capable of permitting the members to operate in a slidable movement relative to one another. In some embodiments, at least elongate member 104 is hollow such that elongate member 101 is permitted to occupy a space within elongate member 104. The elongate members can have a cross-section that is circular, oval, oblong, polygonal, or combinations thereof. The cross-section of the elongate members can have the same shape, or different shapes. In some embodiments, the elongate members are tubular members with a circular cross-section. Elongate members 101 and 104, and caps 107 and 108, can be rigid in manufacture. Suitable materials for construction of the elongate members and caps include, but are not limited to plastic, fiberglass, a metal (e.g. aluminum), a metal alloy (e.g. steel), and combinations thereof. Suitable plastics include, but are not limited to acrylic, polycarbonate, PVC, ABS, and combinations thereof. In some embodiments, elongate members 101 and 104 and caps 107 and 108 are constructed of PVC and/or ABS pipe and pipe fittings.

The components of the inventive apparatus can assume any dimension that permits the components to interconnect and function as disclosed herein. Nevertheless, the following dimensions for various components of the apparatus are being provided by way of example only and should not be considered as limiting the various possible embodiments the apparatus may assume. Thus, elongate member 101 can be tubular with a circular cross section and about 24 inches in length with an inside diameter of about 1.6 inches and an outside diameter of about 1.9 inches. Elongate member 104 can be tubular with a circular cross section and about 17 inches in length and have an inside diameter of about 2 inches and an outside diameter of about 2.4 inches. As used herein, the term "about" means the quantity or value that is stated or that varies (plus or minus) by 1%, 2%, 3%, 4%, 5%, 10%, 15%, 20%, 25%, 35%, or 40% of the stated quantity or value.

Figure 2:
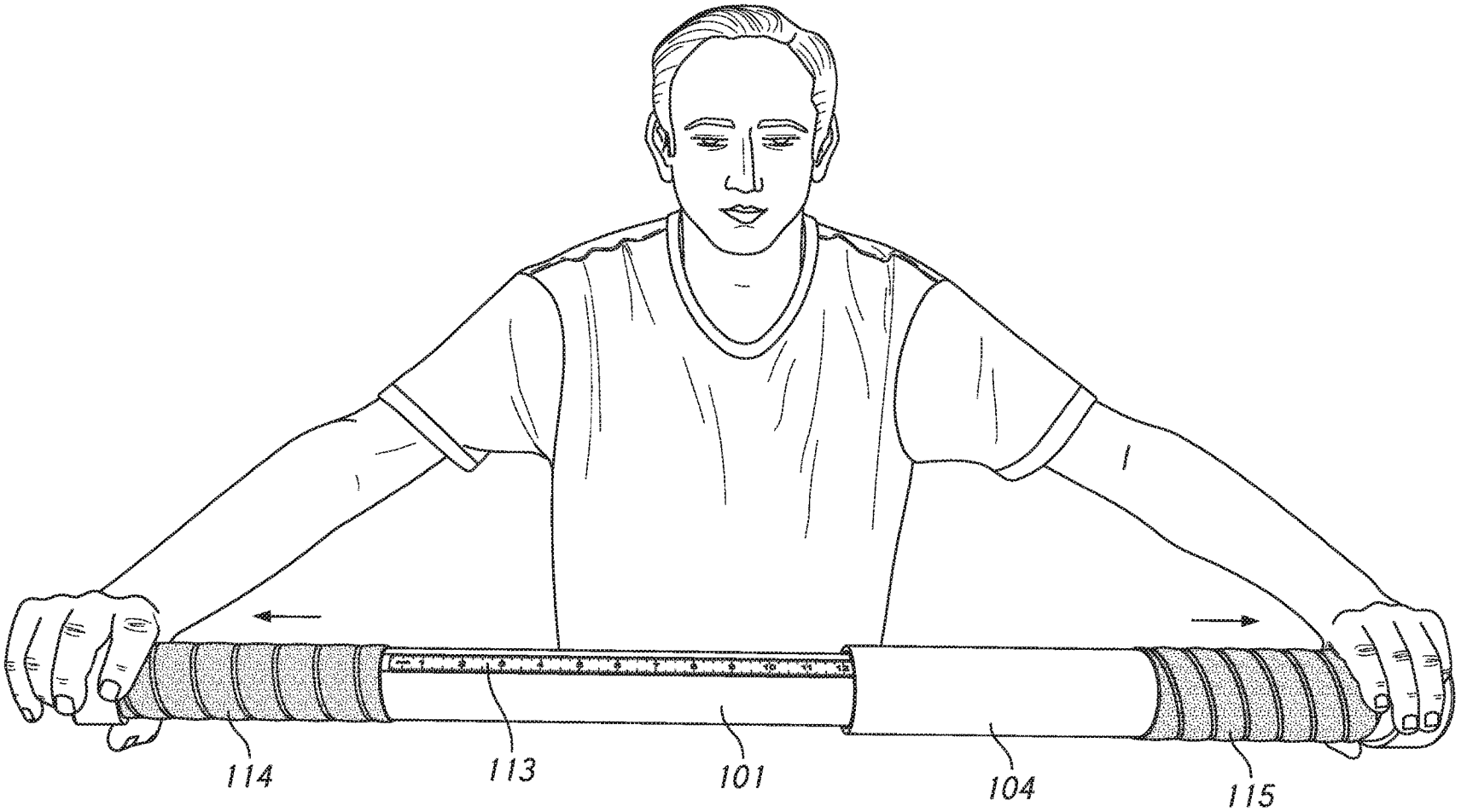
FIG. 2 depicts an embodiment of the inventive apparatus under tension in an extended position.

FIG. 2 depicts an embodiment of the inventive apparatus in an extended position and under tension with elongate member 101 partially withdrawn from elongate member 104. When force is applied by a user, elongate member 101 can be partially withdrawn from elongate member 104. In some embodiments, the apparatus has a natural state wherein the resistance element within the apparatus holds elongate member 101 within elongate member 104 under tension. In some embodiments, the apparatus includes indicia such as meter 113 on the surface of elongate member 101. Meter 113 can have markings at regular intervals according to a unit of length, such as inches and/or centimeters, for example. In the apparatus's non-extended state, the beginning end of meter 113 can be aligned with end 105 of elongate member 104 such that end 105 serves as a marker for measuring on meter 113 the distance that member 101 is withdrawn from elongate member 104. Thus, meter 113 can permit a user or therapist to monitor improvements in the user's strength and use the apparatus at a consistent, desired level of resistance, or according to a rehabilitation or physical therapy protocol. Meter 113 can be, without limitation, a measuring tape affixed to elongate member 101, or markings applied directly to the surface of elongate member 101. In some aspects, meter 113 is depicted as a color gradient with gradual or definite variations in color indicating different lengths of movement of elongate member 101 away from (e.g. out of) elongate member 104. For example, the beginning of meter 113 can be a green color that bleeds into a yellow color for a middle of the distance of movement which bleeds into a red color indicating the maximum level of movement that is permitted by the apparatus.

Figure 3:
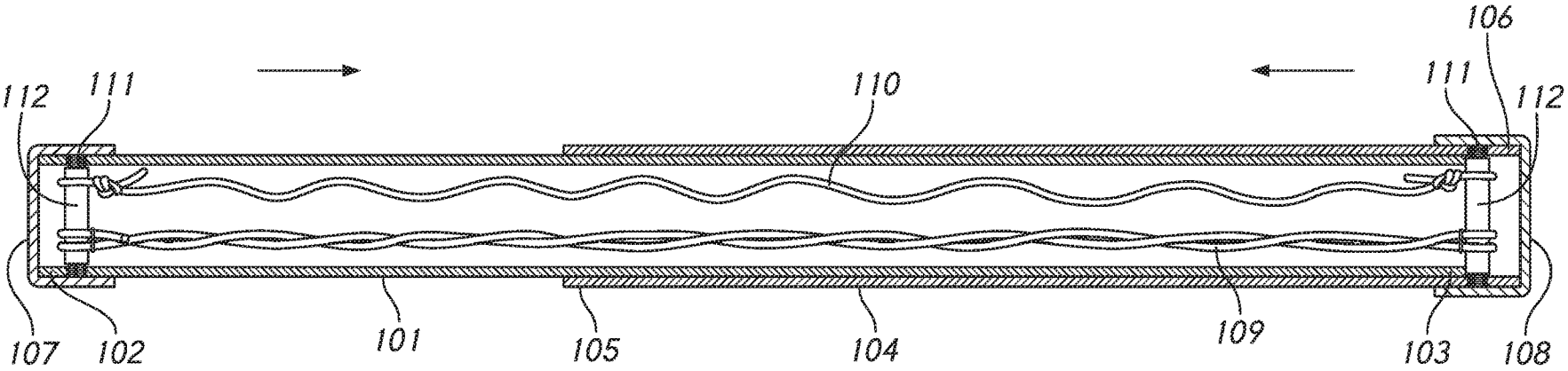
FIG. 3 depicts a cross-sectional view of an embodiment of the inventive apparatus in its natural state.

FIG. 3 depicts a cross-sectional view of an embodiment of the inventive apparatus in its natural state. As shown, elongate member 101 has first end 102 and second end 103. Elongate member 104 has first end 105 and second end 106. Elongate member 101 is disposed within elongate member 104. Varying lengths of elongate member 101 can be disposed within elongate member 104 when the apparatus is in its natural (i.e. non-extended state). The apparatus comprises resistance element 109 and optionally limiting element 110. Resistance element 109 and limiting element 110 are mechanically coupled to the elongate members. In some aspects, limiting element is fixed to the elongate members. Resistance element 109 can comprise one or more elastic bodies. In some embodiments, resistance element 109 is under tension when the apparatus is in its natural, non-extended state such that elastic force holds elongate member 101 within elongate member 104. In other embodiments, resistance element 109 can be of a length such that resistance element 109 is not under tension when the apparatus is in a non-extended position. Resistance element 109 can be an elastic body, such as one or more rubber bands, one or more rubber tubes, one or more bungee cords, or combinations thereof. In some aspects, resistance element 109 is one or more rubber bands in a looped configuration that can optionally be twisted into a helix to increase the resistance provided and prevent resistance element 109 from tangling with itself and/or limiting element 110. One skilled in the art will appreciate that the resistance element can assume any configuration or manufacture that provides resistance against the extraction of elongate member 101 from elongate member 104. In some aspects, the resistance element is one or more pneumatic or hydraulic rams.

The apparatus can comprise limiting element 110. Limiting element 110 can assume any configuration or manufacture that places a limit on the distance that elongate member 101 can be withdrawn from elongate member 104. In some embodiments, limiting element 110 prevents elongate member 101 from being completely withdrawn from elongate member 104. For example, limiting element 110 can prevent end 103 of elongate member 101 from being withdrawn beyond end 105 of elongate member 104. Limiting element 110 can limit the movement of elongate member 101 out of elongate member 104 such that end 103 travels up to 90%, 80%, 70%, 60%, 50%, 40%, 30%, 20%, or 10% of the length of elongate member 104, for example. In the embodiment depicted in FIG. 3, the apparatus is in its natural, non-extended state and limiting element 110 is slack. Limiting element 110 can be at least one inelastic body. Limiting element 110 can be made from one or more cords, one or more ropes, one or more wires, or combinations thereof. In some embodiments, limiting element 110 is made from parachute cord.

In some aspects of the invention, resistance element 109 and limiting element 110 are mechanically coupled to elongate member 101 and elongate member 104. Resistance element 109 and limiting element 110 can be mechanically coupled to any location on the elongate members, and in any manner, that permits resistance element 109 and limiting element 110 to perform their respective functions as disclosed herein. For example, resistance element 109 and limiting element 110 can be mechanically coupled to the elongate members by being connected to the inner walls of the elongate members, to caps 107 and 108, or a combination thereof. In some embodiments, limiting element 110 is fixed to elongate member 101 and elongate member 104. Limiting element can be fixed to the opposing end portions of elongate member 101 and elongate member 104. In the embodiment depicted in FIGS. 3 and 4, resistance element 109 and limiting element 110 are mechanically coupled to the elongate members by pins 111 and pin sheaths 112. While resistance element 109 and limiting element 110 are depicted as being coupled to pin sheaths 112, it will be appreciated by one skilled in the art that resistance element 109 and limiting element 110 can be coupled directly to pins 111 without the use of pin sheaths 112. Resistance element 109 and limiting element 110 can be coupled to pins 111 or pin sheaths 112 by knots, clamps, screws, adhesive, or other similar mechanical connection. Pin sheaths 112 are hollow, tubular bodies that are occupied by pins 111. Pins 111 can traverse the walls of elongate members 101 and 104 through an aperture and have a length that is generally the same as the outside diameter of the respective elongate member with which pin 111 is associated. Pin sheaths 112 can have a length that is the same as, or generally the same as, the inside diameter of the elongate member with which pins sheaths 112 are associated. Pins 111 can be held in place by cap 107 and cap 108. In the apparatus's natural, non-extended state, end 103 of elongate member 101 can be held against pin sheath 112 (or pin 111) under force provided by resistance element 109 being in a stretched, pretensioned configuration.

Figure 4:
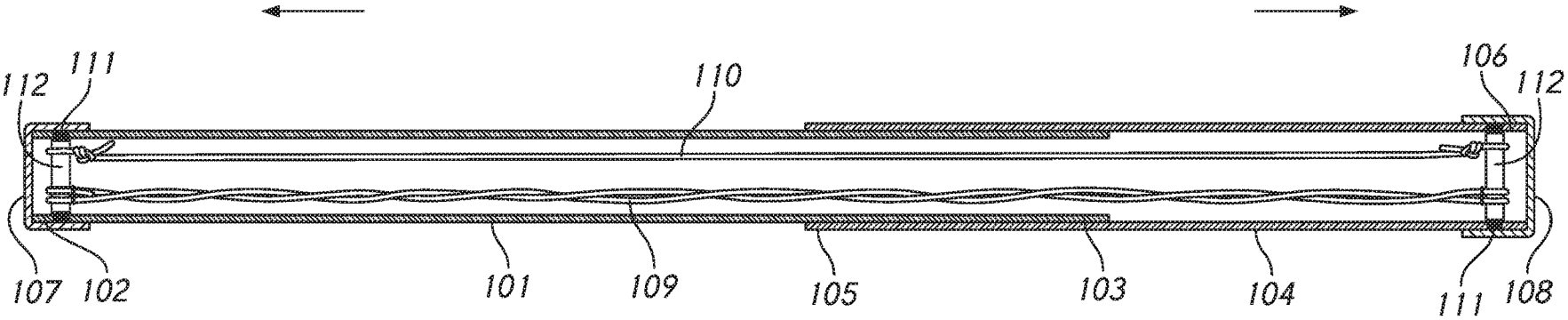
FIG. 4 depicts a cross-sectional view of an embodiment of the inventive apparatus under tension in an extended position.

FIG. 4 depicts the embodiment of FIG. 3 under tension with elongate member 101 partially moved away (e.g. withdrawn) from elongate member 104. The apparatus in FIG. 4 is depicted in a maximum extended configuration with limiting element 110 engaged and preventing further movement of elongate member 101 away from elongate member 104.

Figure 5A:
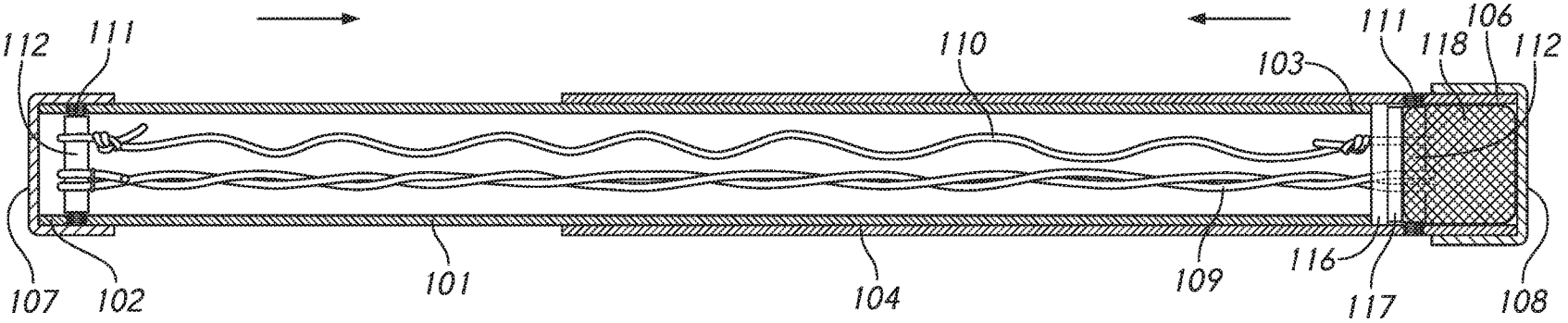
FIG. 5A depicts a cross-sectional view of an embodiment of the inventive apparatus having a buffering assembly with the apparatus in its natural state.

FIG. 5A depicts an embodiment of the inventive apparatus in its natural state and having a buffering assembly. The buffering assembly can buffer or soften the contacting of the parts of the apparatus when the apparatus contracts and returns from an extended state to a natural, pretensioned state, particularly when little or no resistance is exerted against the apparatus returning to its natural state from an extended position. Buffering assembly can comprise buffering body 116 and supporting body 117. Buffering body 116 and supporting body 117 can each have at least one aperture that traverses the plane of the bodies and that is adapted to permit resistance element 109 and limiting element 110 to traverse buffering body 116 and supporting body 117 to connect to pin 111 or pin sheath 112. In the apparatus's natural contracted state, buffering body 116 can contact end 103 of elongate member 101, supporting body 117 can contact pin sheath 112 (or pin 111 in embodiments where pin sheath 112 is omitted), and buffering body 116 and supporting body 117 contact one another. In some aspects of the natural state of the apparatus, buffering body 116 and supporting body 117 can be compressed between end 103 of elongate member 101 and contact pin sheath 112 (or pin 111 in embodiments where pin sheath 112 is omitted) due to the force supplied by resistance element 109 being in a pretensioned state. The apparatus can comprise one or a plurality of buffering body 116 and one or a plurality of supporting body 117. Buffering body 116 can be made of a resilient material. Buffering body 116 can be made of one or more resilient materials selected from, for example, a foam (e.g. an EVA foam), silicone, and rubber. Supporting body 117 can be made from one or more rigid materials, selected from, for example, a metal, a metal alloy, a plastic (e.g. acrylic, polycarbonate, PVC, and ABS), and fiberglass. In some aspects, buffering body 116 is a coating, such as a foam, rubber or silicone coating, that is applied to one or both planar surfaces of supporting body 117. Buffering body 116 and supporting body can have a shape along the plane of the bodies that is circular and of a diameter that is the same as, or generally the same as, the inside diameter of elongate member 104. In some aspects, buffering body 116 has a diameter that is slightly larger than the inside diameter of elongate member 104 such that buffering body 116 provides tension against the inside walls of elongate member 104 and holds supporting body 117 against pin sheath 112 (or pin 111 in embodiments that lack pin sheath 112) when the apparatus is extended and end 103 of elongate member 101 is moved away from contact with buffering body 116.

Still referring to the embodiment of FIG. 5A, the apparatus can comprise one or a plurality of stabilizing bodies 118. Stabilizing body 118 can contact cap 108 and supporting body 117. Stabilizing body 118 can be made of one or more resilient materials, selected from, for example, a foam (e.g. an EVA foam), silicone, and rubber. Stabilizing body 118 can have a length that is the same as the distance between the inside surface of cap 108 and supporting body 117 with the apparatus in its natural state. In some aspects, stabilizing body 118 is made of a resilient material and has a length that is slightly longer than the distance between cap 108 and supporting body 117 (with the apparatus in its natural state) such that stabilizing body 118 provides tension against cap 108 and supporting body 117 thereby holding supporting body 117 against buffering body 116.

Figure 5C:
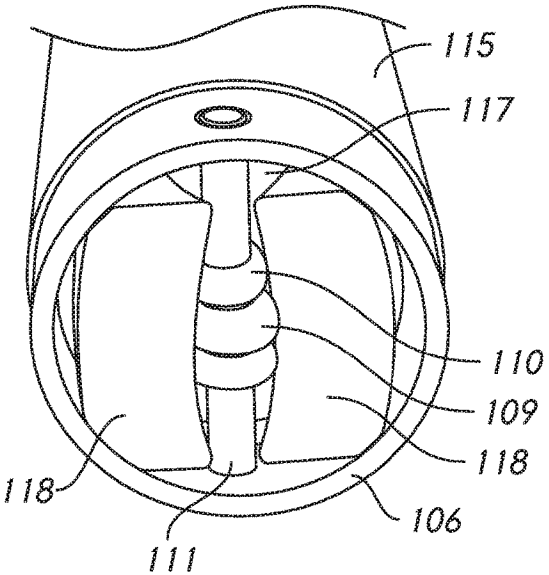
FIG. 5C depicts an end view of the apparatus of FIG. 5A with cap removed.
Figure 5B:
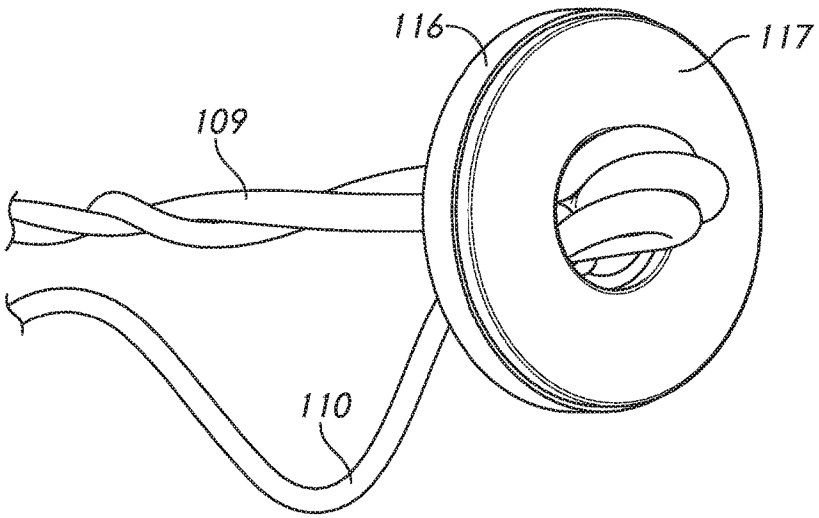
FIG. 5B depicts an embodiment of a buffering assembly of the device of FIG. 5A.

FIG. 5B shows the buffering assembly removed from the apparatus with buffering body 116 in contact with stabilizing body 117. As depicted, buffering body 116 and stabilizing body 117 are circular in shape along the plane of the bodies. Buffering body 116 and stabilizing body 117 have an aperture through which resistance element 109 and limiting element 110 pass to permit their coupling to connecting pin 111 or pin sheath 112.

FIG. 5C shows an end view of the embodiment of FIG. 5A with cap 108 removed. As depicted, the apparatus comprises two stabilizing bodies 118 located laterally of pin 111 with pin 111 connected to resistance element 109 and limiting element 110. As depicted in FIG. 5C, pin 111 can have a length that is the same as the outside diameter of end 106 of elongate member 104 such that when cap 108 is placed on end 106, cap 108 holds pin 111 in place within end 106. The same configuration can exist on the opposing end of the apparatus, wherein pin 111 has a length that is the same as the outside diameter of end 102 such that cap 107 holds pin 111 in place when cap 107 is placed on end 102.

In some aspects, the invention provides a method of strengthening the body of a user. The method can be practiced by a user gripping elongate member 101 in one hand and gripping elongate member 104 with the other hand, then withdrawing elongate member 101 from elongate member 104 for a distance under the resistive force of resistance member 109 thereby exercising the body of the user. The distance of the movement of elongate member 101 out of elongate member 104 can be monitored by the user by reference to meter 113 as disclosed herein. The distance of the movement of elongate member 101 away from elongate member 104 can reach the maximum permitted by the apparatus when limiting element 110 is engaged thereby preventing further movement of elongate member 101 away from elongate member 104. In some embodiments, the apparatus includes at least one of textured surface 114 and textured surface 115 on the surface of the apparatus such that the user may grip the textured surface(s) and enhance their control over the apparatus.

In some embodiments, the invention provides a method of strengthening at least one of the wrists, forearms, and hands. The method can be practiced by a user gripping elongate member 101 using the hand of his leading arm in front of the body while the user's other hand grips elongate member 104 nearer the body, such as with the user's arm tucked and bent near the midsection. The user then straightens his leading arm with his wrist locked thereby moving elongate member 101 away from elongate member 104 for a distance under the tension of resistance member 109 thereby exercising the wrist of the user's leading arm. The user can reach the maximum extendible length of the apparatus by withdrawing elongate member 101 from elongate member 104 until limiting element 110 is engaged and placed under tension thereby preventing further movement of elongate member 101 out of elongate member 104. One skilled in the art will readily appreciate that elongate member 101 and elongate member 104 are ambidextrous with respect to use of the apparatus. The apparatus and method disclosed herein can be used for general exercise and body strengthening as well as physical and rehabilitative therapy, particularly for physical and rehabilitative therapy for injuries to the wrist and hand. The user can be in need of therapy or rehabilitation due to an injury to the hand and/or wrist as a result of trauma, such as a fracture or sprain, or due to a repetitive injury such as carpal tunnel syndrome.

REFERENCE NUMBERS

101—elongate member
102—first end of elongate member 101
103—second end of elongate member 101
104—elongate member
105—first end of elongate member 104
106—second end of elongate member 104
107—elongate member cap
108—elongate member cap
109—resistance element

110—limiting element
111—pin
112—pin sleeve
113—meter
114—textured surface on elongate member 101
115—textured surface on elongate member 104
116—buffering body
117—supporting body
118—stabilizing body

The invention claimed is:

1. A strengthening apparatus, comprising:

a) a first elongate member and a second elongate member, wherein said first elongate member and said second elongate member are slidable relative to one another;

b) at least one resistance element adapted to provide resistance to a sliding movement of said first elongate member relative to said second elongate member; and c) a limiting element adapted to limit said sliding movement;

wherein said at least one resistance element and said limiting element are arranged coaxially within said first elongate member and said second elongate member.

2. The strengthening apparatus of claim 1, wherein said first elongate member is disposed within said second elongate member and said at least one resistance element is adapted to provide resistance to a movement of said first elongate member out of said second elongate member.

3. The strengthening apparatus of claim 1, wherein said at least one resistance element is coupled to said first elongate member and said second elongate member.

4. The strengthening apparatus of claim 1, wherein said first elongate member has a first end and a second end and said second elongate member has a first end and a second end and said at least one resistance element is coupled to said first end of said first elongate member and said second end of said second elongate member.

5. The strengthening apparatus of claim 1, wherein said at least one resistance element comprises at least one elastic body.

6. The strengthening apparatus of claim 1, wherein said at least one resistance element is selected from at least one rubber band, at least one rubber tube, at least one bungee cord, and combinations thereof.

7. The strengthening apparatus of claim 1, wherein said limiting element is fixed to said first elongate member and said second elongate member.

8. The strengthening apparatus of claim 1, wherein said first elongate member has a first end and a second end and said second elongate member has a first end and a second end and said limiting element is coupled to said first end of said first elongate member and said second end of said second elongate member.

9. The strengthening apparatus of claim 1, wherein said limiting element comprises at least one inelastic body.

10. The strengthening apparatus of claim 1, wherein said limiting element is selected from one or more cords, one or more wires, one or more ropes, and combinations thereof.

11. The strengthening apparatus of claim 1, wherein at least one of said first elongate member and said second elongate member are tubular.

12. The strengthening apparatus of claim 1, wherein said strengthening apparatus further comprises a meter adapted to measure a length of said sliding movement.

13. The strengthening apparatus of claim 12, wherein said meter is on a surface of said first elongate member.

14. The strengthening apparatus of claim 1, wherein (i) said first elongate member has a first end and a second end, (ii) said second elongate member has a first end and a second end, wherein said second end of said second elongate member is connected to a pin, (iii) said second end of said first elongate member is disposed within said second elongate member, and (iv) said strengthening apparatus further comprises a buffering body and a supporting body, wherein said buffering body and said supporting body are positioned between said second end of said first elongate member and said pin.

15. The strengthening apparatus of claim 14, wherein said buffering body contacts said second end of said first elongate member and said supporting body contacts said pin when said strengthening apparatus is in a natural state.

16. The strengthening apparatus of claim 14, wherein said buffering body comprises a resilient material and said supporting body comprises a rigid material.

17. The strengthening apparatus of claim 14, wherein said buffering body comprises a material selected from foam, silicone, rubber, and combinations thereof.

18. The strengthening apparatus of claim 14, wherein said supporting body comprises a material selected from a metal, a metal alloy, plastic, fiberglass, and combinations thereof.

19. The strengthening apparatus of claim 1, wherein at least one of said first elongate member and said second elongate member comprise a textured surface that is adapted for gripping by a user.

20. A strengthening apparatus, comprising:

a) a first tubular member having a first end and a second end;

b) a second tubular member having a first end and a second end, wherein said second end of said second tubular member is connected to a pin;

c) wherein said second end of said first tubular member is disposed within said second tubular member, and said first tubular member and said second tubular member are slidable relative to one another;

d) at least one elastic band coupled to said first end of said first tubular member and said pin, wherein said at least one elastic band is adapted to provide resistance to movement of said first tubular member away from said second tubular member;

e) an inelastic cord coupled to said first end of said first tubular member and said pin, wherein said inelastic cord is adapted to limit said movement, wherein said at least one elastic band and said inelastic cord are arranged coaxially within said first tubular member and said second tubular member;

wherein said first tubular member comprises a meter adapted to measure a length of said movement; and wherein said first tubular member and said second tubular member comprise a textured surface that is adapted for gripping by a user.

21. The strengthening apparatus of claim 20, further comprising a resilient buffering body and a rigid stabilizing body, wherein said resilient buffering body and said rigid stabilizing body are positioned between said second end of said first tubular member and said pin.

* * * * *